US005876132A

United States Patent [19]

Zable

[11] Patent Number: 5,876,132

[45] Date of Patent: Mar. 2, 1999

[54] METHOD AND SYSTEM FOR HIGH CHARACTER DENSITY PRINTING UTILIZING LOW PEL DENSITY CHARACTERS

[75] Inventor: Jack Louis Zable, Niwot, Colo.

[73] Assignee: International Business Machines Corporation, Armonk, N.Y.

[21] Appl. No.: 740,041

[22] Filed: Oct. 23, 1996

Related U.S. Application Data

[63] Continuation of Ser. No. 447,855, May 23, 1995.

[51] Int. Cl.[6] ..... B41J 19/34

[52] U.S. Cl. ..... 400/306; 400/9; 400/124.01

[58] Field of Search ..... 400/9, 10, 303, 400/304, 306, 279, 320, 322, 124.01; 395/108, 109, 110

[56] References Cited

U.S. PATENT DOCUMENTS

| | | | |
|---|---|---|---|
| 3,354,816 | 11/1967 | Giannuzzi | 400/306 |
| 3,999,168 | 12/1976 | Findley et al. | 400/306 |
| 4,213,714 | 7/1980 | Jones et al. | 400/306 |
| 4,225,249 | 9/1980 | Kettler | 400/306 |
| 4,321,599 | 3/1982 | Yoshiba | 400/306 |
| 4,321,610 | 3/1982 | Moore et al. | 346/108 |
| 4,371,274 | 2/1983 | Jaeger | 395/108 |
| 4,508,463 | 4/1985 | Wang et al. | 400/124 |
| 4,536,773 | 8/1985 | Kokaji et al. | 346/74.2 |
| 4,642,653 | 2/1987 | Ito et al. | 346/1.1 |
| 4,740,693 | 4/1988 | Malcolm | 400/306 |
| 4,750,009 | 6/1988 | Yoshimura | 346/140 R |
| 4,757,462 | 7/1988 | Sato et al. | 400/306 |
| 4,774,882 | 10/1988 | Obsawa et al. | 400/166 |
| 4,783,667 | 11/1988 | Brooks | 346/76 PH |
| 4,837,564 | 6/1989 | Ogawa et al. | 340/750 |
| 4,849,747 | 7/1989 | Ogawa et al. | 340/730 |
| 4,883,377 | 11/1989 | Takeda | 400/303 |
| 5,002,375 | 3/1991 | Komplin et al. | 350/447 |
| 5,026,974 | 6/1991 | Franklin et al. | 235/449 |
| 5,124,732 | 6/1992 | Manzer et al. | 346/154 |
| 5,221,921 | 6/1993 | Statt | 340/735 |

*Primary Examiner*—Edgar S. Burr
*Assistant Examiner*—Steven S. Kelley
*Attorney, Agent, or Firm*—Felsman, Bradley, Gunter & Dillon, LLP

[57] ABSTRACT

A method and system for printing a high density sequence of characters of M characters per inch from a predetermined character set. A print head having multiple print wires or pins is utilized to print a matrix of "dots" at a selected pel density, preferably 4M pels per inch for higher print throughput. The character set is then examined and a small selected number of characters are identified which require a character matrix having a width of four pels to achieve a desired level of legibility. All remaining characters in a character set are assigned a character matrix having a width of three or three and one-half pels in order to achieve the desired level of legibility. Thereafter, a high density sequence of characters having a high level of legibility can be printed at low pel densities having only a slight degradation in legibility in the event that two characters which each require a four pel width character matrix are adjacent.

9 Claims, 2 Drawing Sheets

METHOD AND SYSTEM FOR HIGH CHARACTER DENSITY PRINTING UTILIZING LOW PEL DENSITY CHARACTERS

This is a continuation, of application Ser. No. 08/447,855, filed 23 May 1995.

BACKGROUND OF THE INVENTION

1. Technical Field

The present invention is directed in general to an improved impact printer and more particularly to an improved font system for utilization with a high character density impact printer system. Still more particularly the present invention is related to an improved low pel density font system for utilization with a high character density impact printer system.

2. Description of the Related Art

So-called "dot-matrix" printers are known in the prior art. Such printers typically take the form of a print head having a number of print pins or wires which are arranged in rows and columns wherein the pins may be individually actuated in combinations in a manner well known in the art to print characters as the print head is moved across a piece of paper or other material upon which it is desired to print characters. Dot printers may also be implemented utilizing an ink jet printer which utilizes a number of individual ink jets out of which droplets of ink are pulsed in combinations to print characters as a sequence of dots.

Dot printers such as the type described herein are capable of printing at speeds faster than other mechanical printers such as conventional typewriter or daisy wheel printers; however, the print resolution or quality of existing dot printers is generally inferior to the resolution or quality of print obtained from typewriters and daisy wheel printers. This is due to the fact that the dots making up the characters are discrete unconnected dots and thereby yield low print resolution. In addition, due primarily to the low print resolution the ability to provide variable print fonts is greatly limited.

A typical dot matrix character formed by such a system is generally created by sequentially moving the print head across the paper and selectively actuating various pins or wires which are arranged either vertically or horizontally on the head.

Modern impact type dot printers are also capable of printing high density imprints in a selected mode of operation by overlapping the imprints of the dots which are utilized to form the characters; however, this technique typically requires additional time and greater complexity of control circuitry.

Typically, a printed character for matrix printers in standard print quality mode is created by printing appropriate dots within a 7×4 cell character matrix which is seven dots high and four dots wide. In a normal system the pel density in the vertical direction is generally seventy-two pels per inch and in the horizontal direction the pel density is sixty pels per inch. Thus, printing can occur at a character density of ten characters per inch, allowing four horizontal characters for each letter with one pel on each side of the character for spacing.

However, if higher character density is desired in a system with a fixed pel density the character matrix for each character must necessarily be smaller in horizontal dimension. A reduction in the size of the character matrix often results in a perception of poor print quality as certain letters are not easily formed utilizing smaller character matrixes.

It should thus be apparent that a need exists for a method and system which permits high character density printing to occur within a low pel density printer.

SUMMARY OF THE INVENTION

It is therefore one object of the present invention to provide an improved impact printer system.

It is another object of the present invention to provide an improved font system for utilization with a high character density impact printer system.

It is yet another object of the present invention to provide an improved low pel density font system for utilization with a high character density impact printer system.

The foregoing objects are achieved as is now described. The method and system of the present invention may be utilized to print a high density sequence of characters of M characters per inch from a predetermined character set. A print head having multiple print wires or pins is utilized to print a matrix of "dots" at a selected horizontal pel density, preferably 5M pels per inch (with a minimum of one pel between characters) or greater for legibility. However, for high speed a horizontal density of 4M is desired. The character set is then examined and a small selected number of characters are identified which require a character matrix having a width of four pels to achieve a desired level of legibility. All remaining characters in a character set are assigned a character matrix having a width of three or three and one-half pels in order to achieve the desired level of legibility. Thereafter, a high density sequence of characters having a high level of legibility can be printed at low pel densities having only a slight degradation in legibility in the event that two characters which each require a four pel width character matrix are adjacent.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF PREFERRED EMBODIMENT

Figure 1:
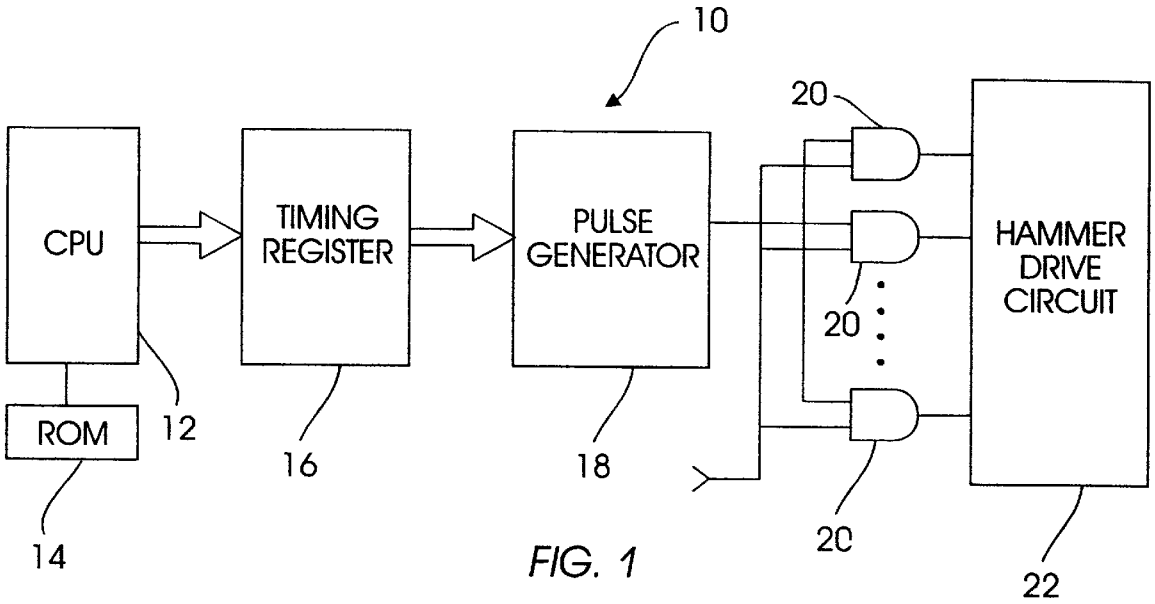
FIG. 1 is a high level block diagram of an impact printer system which may be utilized to implement the method and system of the present invention.

With reference now to the figures and in particular with reference to FIG. 1, there is depicted a high level block diagram of an impact printer system 10 which may be utilized to implement the method and system of the present invention. As illustrated, system 10 includes a central processing unit 12 coupled to a read only memory (ROM) 14. Read only memory (ROM) 14 is utilized to store the various character matrices utilized to form the font of the present invention and CPU 12, in combination with the data stored within ROM 14 is then utilized to control timing register 16 and pulse generator 18 to generate a series of control pulses which may be applied to gate circuits 20 which generate an energizing pulse to be applied to hammer drive circuit 22. In this manner a plurality of characters formed by dots within a character matrix may be simply and efficiently formed in accordance with the method and system of the present invention.

Figure 2:
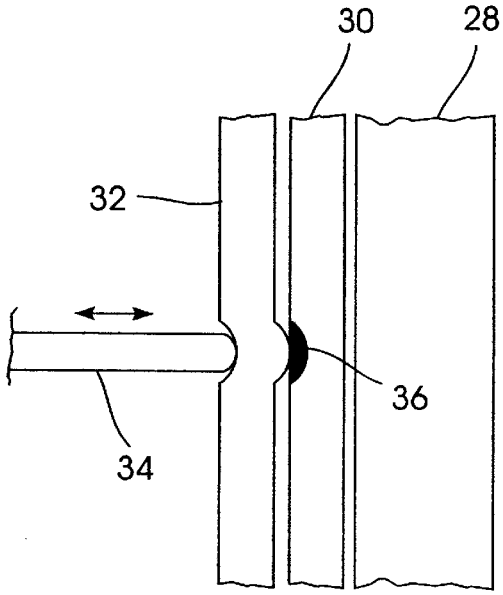
FIG. 2 is an enlarged view of the printing mechanism of the impact printer system of FIG. 1.

Referring now to FIG. 2, there is depicted an enlarged view of the printing mechanism of impact printer system 10 of FIG. 1. As illustrated, a platen 28 is provided to support paper 30 between platen 28 and printer ribbon 32. A single wire or pin 34 is depicted which is movable along its horizontal axis in a selective manner utilizing solenoids or other suitable drive devices to strike ribbon 32 causing the creation of a dot 36 on paper 30. In known impact printing systems a print wire or pin having a diameter of 0.014 inches may be utilized to create a dot 36 having a diameter of approximately 0.017 inches.

Figure 3:
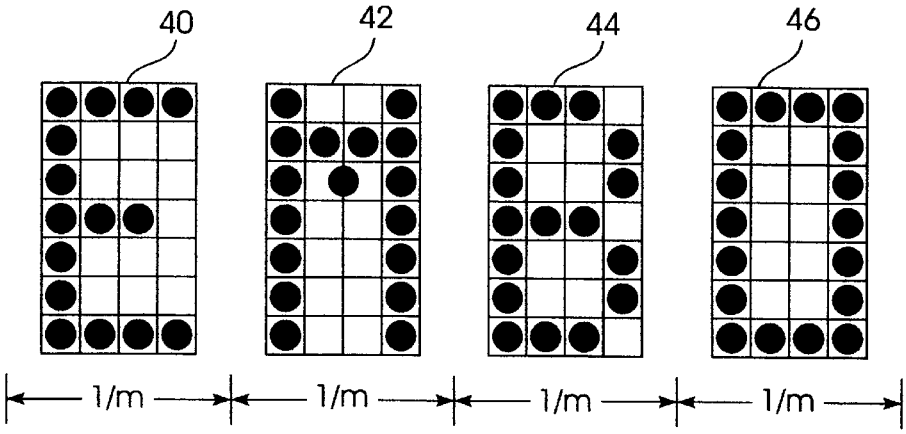
FIG. 3 (PRIOR ART)
FIG. 3 is an enlarged pictorial representation of a prior art font utilized with a low character density system.

With reference now to FIG. 3 there is depicted an enlarged pictorial representation of a prior art font utilized with low character density systems. As depicted, each of the characters 40, 42, 44 and 46 are created within a 7×4 pel character matrix. For simplicity of illustration each of the characters 40, 42, 44 and 46 are illustrated utilizing a single dot within each cell within the character matrix; however, those skilled in the art will appreciate that in systems having one-half pel addressability, for example, additional dot locations will be provided. However, adjacent horizontal dots cannot be located any closer than a distance of one pel, due to print wire or pin cycle time performance restrictions. Higher addressability, i.e., smaller fractions of a pel may be utilized to improve character shape, although ½ pel addressability is the most common. Pel density addressability is typically a factor of two or greater than the basic horizontal pel density. This ratio or addressability factor is typically equal to two. The addressability factor is the inverse of the fraction of a pel that a dot can be placed off of the basic horizontal pel density grid.

As depicted within FIG. 3, in a system having a horizontal pel density of sixty pels per inch, ten characters per inch may be easily printed in a highly legible manner utilizing this font. Thus, for ten characters per inch with a sixty pel per inch horizontal density each character is allowed a space equal to six pels or 1/M inches for a character density of M characters per inch. For low pel density printing, the vertical pel density is typically seventy-two pels per inch. It should thus be apparent that 7×4 character matrix can be simply provided, each character having a single pel of space adjoining each side of the character. Thus, the letters "E," "M," "B," and "O" may be simply and legibly presented. Higher or denser pel densities will allow for denser matrices and greater legibility. However, higher pel densities result in lower print speeds.

Figure 4:
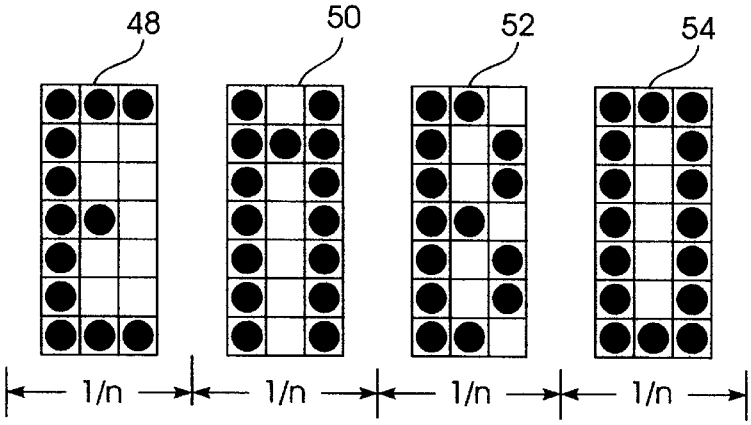
FIG. 4 (PRIOR ART)
FIG. 4 is an enlarged pictorial representation of a prior art font utilized with a high character density system.

Next, with reference to FIG. 4, there is depicted an enlarged pictorial representation of a prior art font which may be utilized with a high character density system. Thus, consider that in a fifteen character per inch system in order to provide the legibility and clarity depicted within FIG. 3 six pels per character would be required. Thus, for a fifteen character per inch system a pel density of ninety pels per inch would be required. While some dot matrix printers are capable of producing this pel density the additional time required in throughput to produce output at this pel density mitigates against the utilization of higher pel densities. Utilizing five pels per character with one pel space between characters, at fifteen characters per inch, would require a horizontal pel density of seventy-five dots per inch. This also would cause a significant print speed reduction.

Consequently, in systems in which higher character densities are desired, such as fifteen characters per inch, a 7×3 character matrix is often utilized. Thus, as depicted within FIG. 4, characters 48, 50, 52 and 54 are each presented within a 7×3 character matrix. In general for legibility, at least one pel space is required between adjacent characters or:

$$\frac{P}{M} - X \geqq = 1$$

where P=horizontal pel density, M=character density, X=number of horizontal pels in character matrix.

Still referring to FIG. 4, in this situation the printing of fifteen characters per inch in a sixty pel per inch horizontal resolution system requires that the envelope into which each character is printed be not greater than four pels wide. Consequently, each of the characters is printed within a three pel wide character matrix and one-half pel is provided adjacent to each character for spacing. As those skilled in the art will appreciate while this font permits the system to provide a fifteen character per inch output utilizing a sixty pel per inch horizontal resolution selected characters cannot be legibly printed utilizing the narrower character matrix. An example of this is character 50, the letter M of FIG. 3.

Figure 5:
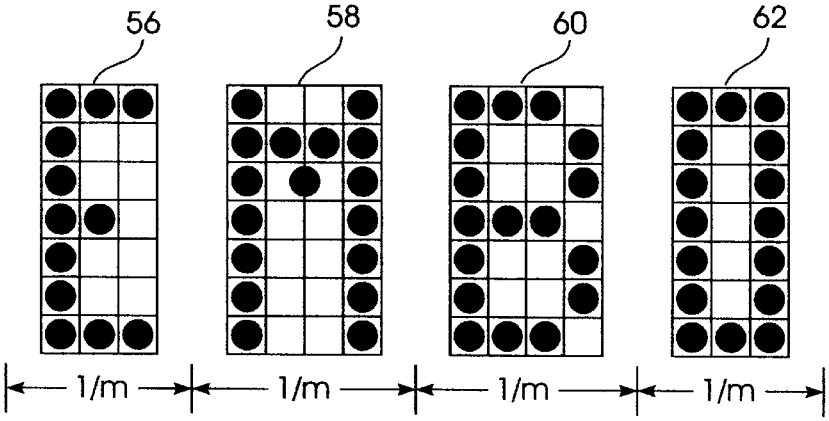
FIG. 5 (PRIOR ART)
FIG. 5 is an enlarged pictorial representation of the font of the present invention utilized with a high character density system in accordance with the method and system of the present invention.

With reference now to FIG. 5, there is depicted an enlarged pictorial representation of the font utilized with a high character density system in accordance with the method and system of the present invention. As depicted, characters 56, 58, 60 and 62 are provided utilizing various different widths of character matrix. This is accomplished by identifying a small selected number of characters which cannot be legibly produced within a 7×3 character matrix. In the depicted embodiment of the present invention this small selected number of characters comprises the letters "M," "N," "W," and various special characters such as fractional number font characters or the like. Each of these characters is then created utilizing a 7×4 character matrix which is stored within ROM 14 of FIG. 1. Alternately, the remaining characters are formed utilizing either a 7×3 character matrix or a 7×3½ character matrix. Thus, as illustrated within FIG. 5, the character "E," as indicated at reference numeral 56 is clearly and legibly produced in a 7×3 matrix. In contrast, the letter "M," as depicted at reference numeral 58, requires a 7×4 matrix to be legibly produced. The letter "B," as indicated at reference numeral 60 can be simply and legibly produced within a character matrix having three and one-half pels in width and finally, the letter "O," as indicated at reference numeral 62, may be simply and legibly produced within a character matrix of three pels in width.

In the creation of character fonts utilizing this technique, characters that are symmetric about a vertical centerline require an integer number of horizontal pels. Characters that are non-symmetric about a vertical centerline, and have curved surfaces, such as B or D, will look aesthetically more pleasing with a character matrix that is a non-integer, for example, 3½ pels (½ pel addressability). Additionally, for printing where there is minimal overlap between adjacent dots, as in the case of low pel density printing, there is a preferred slope to be utilized for slanted lines. The slope is one pel down and ½ pel across (or less—depending on the horizontal addressability), allowing some degree of overlap between the dots making up a slanted line.

In the manner set forth herein it is therefore possible to produce highly legible characters in a low pel density system at high character densities by determining that a small selected number of characters may be printed utilizing a character matrix which is wider than would generally be permitted and that the slight degradation which occurs during those low probability occasions where two such characters occur in adjacent positions does not substantially degrade the legibility of the resultant font.

Thus, Applicant has discovered that in a low pel density system wherein M characters per inch is the desired character density a highly legible font may be produced by presenting a small selected number of characters within a character matrix which is substantially equal to 1/M inches in width such that no spacing occurs adjacent to such characters.

While the invention has been particularly shown and described with reference to a preferred embodiment, it will be understood by those skilled in the art that various changes in form and detail may be made therein without departing from the spirit and scope of the invention.

I claim:

1. A method for printing a high density sequence of characters from a predetermined character set, said method comprising the steps of:

for a character sequence which includes M characters per inch;

printing within said character sequence each of a small number of preselected characters from said predetermined character set within a 7×4 pel-rectanular character matrix having a width eaual to 1/M inches such that a printed portion of each of said small number of preselected characters has a total width equal to 1/M inches; and printing selected remaining characters within said character sequence from said predetermined character set such that a printed portion of said selected remaining characters has a total width of 3½ pels.

2. The method for printing a high density sequence of characters according to claim 1, further including the step of printing each symmetric character from said predetermined character set within a rectangular character matrix having a width equal to an integer number of pels.

3. The method for printing a high density sequence of characters according to claim 1, further including the step of printing each nonsymmetric character from said predetermined character set within a rectangular character matrix having a width equal to a noninteger number of pels.

4. The method for printing a high density sequence of characters according to claim 1, further including the step of printing each character from said predetermined character set with a pel addressability that is a factor of two or greater than normal pel density.

5. A system for printing a high density sequence which includes M characters per inch from a predetermined character set, said system comprising:

a plurality of print wires for selectively printing a matrix of dots; and control means coupled to said plurality print wires for printing within said character sequence each of a small number of preselected characters from said predetermined character set within a 7×4 pel rectangular character matrix having a width equal to 1/M inches such that a printed portion of each of said small number of preselected characters has a total width equal to 1/M inches and for printing selected remaining characters within said character sequence from said predetermined character set such that a printed portion of said selected remaining characters has a total width of 3½ pels.

6. The system according to claim 5, wherein said control means prints each symmetric character from said predetermined character set within a rectangular character matrix having a width equal to an integer number of pels.

7. The system according to claim 5, wherein said control means prints each nonsymmetric character from said predetermined character set within a rectangular character matrix having a width equal to a noninteger number of pels.

8. The system according to claim 5, wherein said control means prints each character from said predetermined character set with a pel addressability that is a factor of two or greater than normal pel density.

9. A system for printing a high density sequence of M characters per inch utilizing a pel density of four M pels per inch, said system comprising:

a plurality of print wires for selectively printing a matrix of dots;

means coupled to said plurality of print wires for printing each of a small number of preselected characters from said predetermined character set within a character matrix having a width equal to four pels; and means coupled to said plurality of print wires for printing selected remaining characters from said predetermined character set within a character matrix having a width of three and one-half pels.

* * * * *